US008045909B2

(12) United States Patent
Sakaguchi et al.

(10) Patent No.: US 8,045,909 B2
(45) Date of Patent: Oct. 25, 2011

(54) SURFACE TREATMENT DEVICE, IMAGE FORMING APPARATUS, BELT MEMBER, AND IMAGE FORMING METHOD

(75) Inventors: Yasuo Sakaguchi, Minamiashigara (JP); Fumio Daishi, Minamiashigara (JP); Noboru Endo, Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 1107 days.

(21) Appl. No.: 11/506,825

(22) Filed: Aug. 21, 2006

(65) Prior Publication Data

US 2007/0237556 A1 Oct. 11, 2007

(30) Foreign Application Priority Data

Apr. 6, 2006 (JP) ..... 2006-105170

(51) Int. Cl.
*G03G 15/20* (2006.01)

(52) U.S. Cl. ..... 399/333; 399/329; 399/341

(58) Field of Classification Search ..... 430/124; 399/333, 341, 329
See application file for complete search history.

(56) References Cited

U.S. PATENT DOCUMENTS

| | | | | |
|---|---|---|---|---|
| 5,519,479 | A * | 5/1996 | Shimizu et al. | 399/333 |
| 5,641,568 | A * | 6/1997 | Satoh et al. | 428/332 |
| 6,002,910 | A * | 12/1999 | Eddy et al. | 399/329 |
| 6,983,119 | B2 | 1/2006 | Nakayama | |
| 7,195,853 | B1 * | 3/2007 | Pickering et al. | 430/124.33 |
| 2004/0091294 | A1 * | 5/2004 | Tani et al. | 399/324 |
| 2004/0151515 | A1 | 8/2004 | Nakayama | |

FOREIGN PATENT DOCUMENTS

| | | |
|---|---|---|
| JP | A 9-325635 | 12/1997 |
| JP | A 10-268678 | 10/1998 |
| JP | A 2000-060050 | 2/2000 |
| JP | A 2000-330405 | 11/2000 |
| JP | A 2004-109687 | 4/2004 |
| JP | A-2004-184476 | 7/2004 |
| JP | A-2004-325934 | 11/2004 |
| JP | A-2005-134779 | 5/2005 |
| JP | A-2005-250274 | 9/2005 |

* cited by examiner

*Primary Examiner* — David Porta
*Assistant Examiner* — Bryan Ready
(74) *Attorney, Agent, or Firm* — Oliff & Berridge, PLC

(57) ABSTRACT

A surface treatment device includes a belt member having a surface layer in which plural kinds of rubbers having a different hardness mixedly exist. In the device, a press/heat unit presses a recording medium with a toner image formed against the belt member such that the toner image contacts with the surface layer, and heats the recording medium to melt at least a surface of the toner image.

23 Claims, 4 Drawing Sheets

SURFACE TREATMENT DEVICE, IMAGE FORMING APPARATUS, BELT MEMBER, AND IMAGE FORMING METHOD

BACKGROUND (i) Technical Field

The invention relates to a surface treatment device for subjecting a toner image to a surface treatment, an image forming apparatus for forming a toner image on a recording medium, a belt member with a surface of which a toner image is pressed to contact to be heated, and an image forming method of forming a toner image on the recording medium.

(ii) Related Art

In recent years, an image forming apparatus typified by a printer, a copy machine has become widespread and technologies relating to various elements constituting the image forming apparatus also have become widespread. Recently, technologies for easily taking a photograph such as a technology of a digital camera, and the like have become widespread, and a request for creating a high quality image like a photograph has been increased in the field of the image forming apparatus. Of image forming apparatuses employing an electrophotography system, an image forming apparatus for forming a high quality image specific to a photographic image by subjecting a toner image to a surface treatment at a final stage of image formation appears. Such surface treatment is carried out by applying heat to the toner image in a state in which a surface treatment belt member is pressed to contact with the toner image on the recording medium. In such surface treatment, a toner containing a wax with a low melting point is used. When the toner image is heated, the wax is melted prior to the other components (resins containing colorants and the like) of the toner and adhered to the surface of a belt member, and the resins containing the colorants and the like are melted on the wax. The toner image can be easily separated from the surface of the belt member by the use of the wax. However, as the toner images are subjected to a fixing treatment repeatedly, the wax is adhered on the surface of the belt member as it is, and thus irregularities are formed on the surface of the belt member. When many irregularities are formed on the surface of the belt member, many irregularities are also formed on the surface of an image subjected to the surface treatment by reflecting the surface shape of the belt member. As a result, an image which lacks glossiness and whose quality as a photographic image is deteriorated is formed. To cope with the above problem, recently, there is proposed a belt member whose surface is covered with fluorocarbon siloxane rubber that is a material to which wax is unlikely to adhere.

SUMMARY

According to an aspect of the invention, there is provided a surface treatment device including a belt member having a surface layer in which plural kinds of rubbers having a different hardness mixedly exist, and a press/heat unit that presses a recording medium, on that a toner image is formed, against the belt member such that the toner image contacts with the surface layer and heats the recording medium to melt at least a surface of the toner image.

BRIEF DESCRIPTION OF THE DRAWINGS

Exemplary embodiments of the invention will be described in detail based on the following figures, wherein.

DETAILED DESCRIPTION

First Exemplary Embodiment

A first exemplary embodiment according to an aspect of the invention will be explained below with reference to the drawings.

Figure 1:
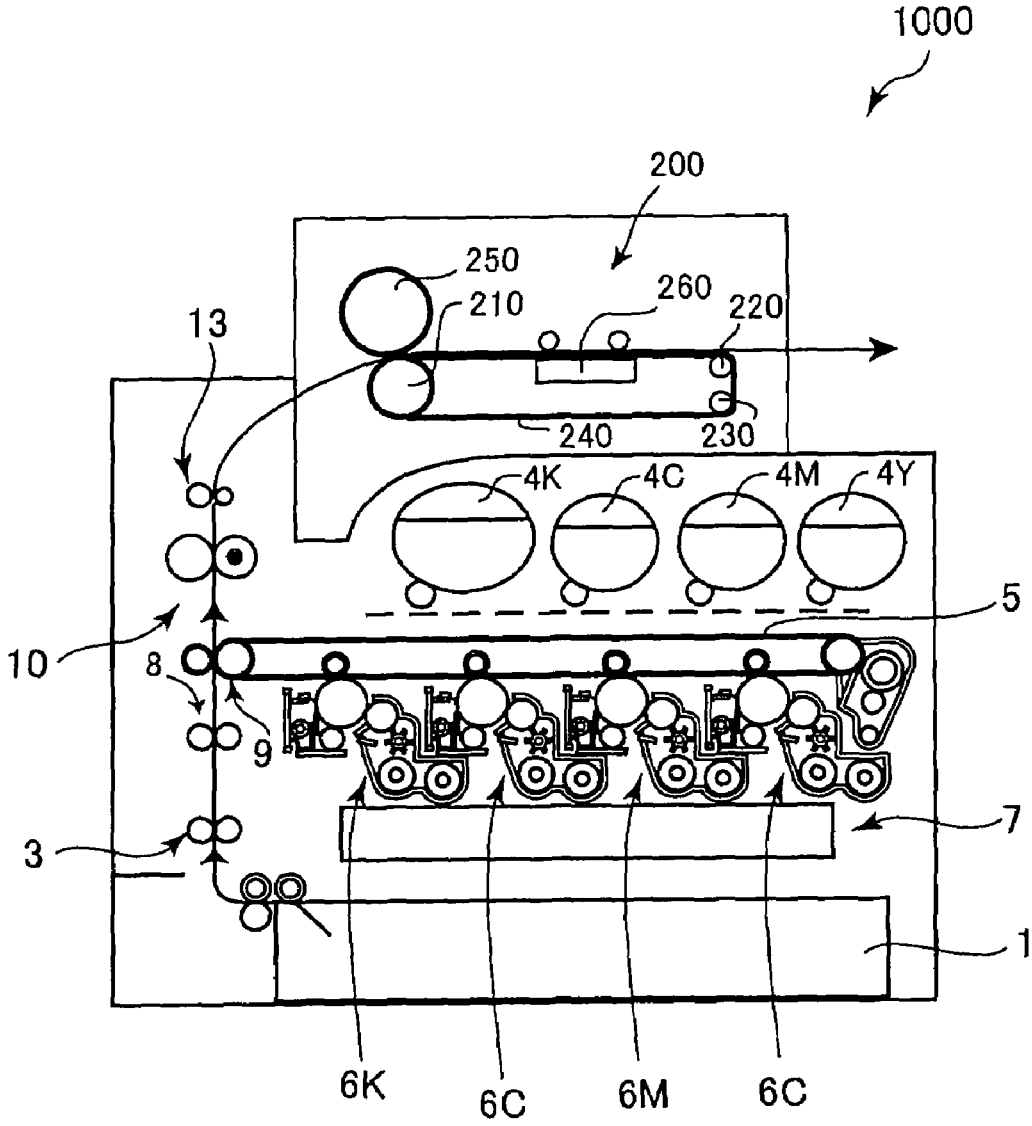
FIG. 1 is an overall constitutional view of an image forming apparatus of a first exemplary embodiment.

FIG. 1 is an overall constitutional view of an image forming apparatus of the first exemplary embodiment.

The image forming apparatus of the embodiment is a color printer for forming a photographic image.

The image forming apparatus 1000 includes four toner image forming units 6K, 6C, 6M and 6Y that correspond to respectively color toners of black (K), cyan (C), magenta (M) and yellow (Y), an intermediate transfer belt 5, a pair of secondary transfer rolls 9, an exposure unit 7 for irradiating a laser beam, a primary fixing unit 10 for primarily fixing a toner image, four toner cartridges 4K, 4C, 4M, and 4Y for replenishing the four toner image forming units with toners of the respective color components, and a tray 1 on which the recording mediums are accumulated. Further, a surface treatment unit 200 is disposed on an upper portion of the image forming apparatus 1000 to carry out the surface treatment of an image by secondarily fixing the toner images. The surface treatment unit 200 corresponds to an example of a surface treatment device according to an aspect of the invention.

The surface treatment unit 200 includes three rolls of a heat roll 210, an exfoliation roll 220, and a meandering control roll 230, a fixing belt 240 stretched by these three rolls and traveling circularly clockwise in FIG. 1, a press roll 250 pressed against the fixing belt 240, and a cooling heat sink 260 for cooling the fixing belt 240. The fixing belt 240 corresponds to an example of a belt member accroding to an aspect of the invention. Further, a combination of the press roll 250 and the heat roll 210 corresponds to an example of a heat/press unit according to an aspect of the invention, and a combination of the exfoliation roll 220 and the fixing belt 240 corresponds to an example of an exfoliation unit according to an aspect of the invention.

The heat roll 210 is a cylindrical roll that is rotated by a drive mechanism (not shown in the drawing) in the direction indicated by an arrow A in the drawing. A not shown halogen lamp (not shown in the drawing) with a power consumption of 320 W is included in the cylindrical roll, and the heat generated by the halogen lamp is conducted to the heat roll 210 surrounding the heat roll 210 to keep the surface temperature of the heat roll 210 constant. Further, the heat of the heat roll 210 is transmitted to the fixing belt 240 and used as the heat applied to toner images as described below. The inner surface of the cylinder of the heat roll 210 is a metal core made of aluminum. An elastic layer with 2 mm thickness made of silicon rubber which is a kind of heat resistant rubber overlaps on the core metal. Further, a mold release layer composed of tetrafluoroethyrene-perfluoroalkylvinylether copolymer (PFA) is formed on the outer surface of the elastic layer to prevent contamination and to reduce aging of the surface that is caused when it slides on the back surface of the belt.

The press roll 250 is a cylindrical roll for applying pressure to the toner images on the recording medium between the roll and the fixing belt 240. Further, the press roll 250 assists the heat roll 210 and plays a role in applying heat to the recording medium, and a halogen lamp (not shown in the drawing) with a power consumption of 300 W is disposed in the press roll 250. The surface temperature of the press roll 250 is kept constant by the heat generated by the halogen lamp. The arrangement of the press roll 250 is the same as that of the heat roll 210 and has a metal core made of aluminum, an elastic layer composed of silicon rubber, and a separation layer composed of PFA.

When the hardness of the elastic layer of the press roll 250 and the hardness of the elastic layer of the heat roll 210 are evaluated by JIS-A hardness (JIS K6253 "test method of hardness of vulcanized rubber and thermoplastic rubber"), each of the elastic layers has hardness of A40/S. The JIS-A hardness is a standard for measuring hardness of rubber and indicates a rubber hardness by inserting a needle into the surface of the rubber to deform the rubber as a DUT using a type A durometer, and by measuring an amount of the deformation of the rubber to digitize the amount.

Next, an image forming operation of the image forming apparatus 1000 will be explained.

Figure 2:
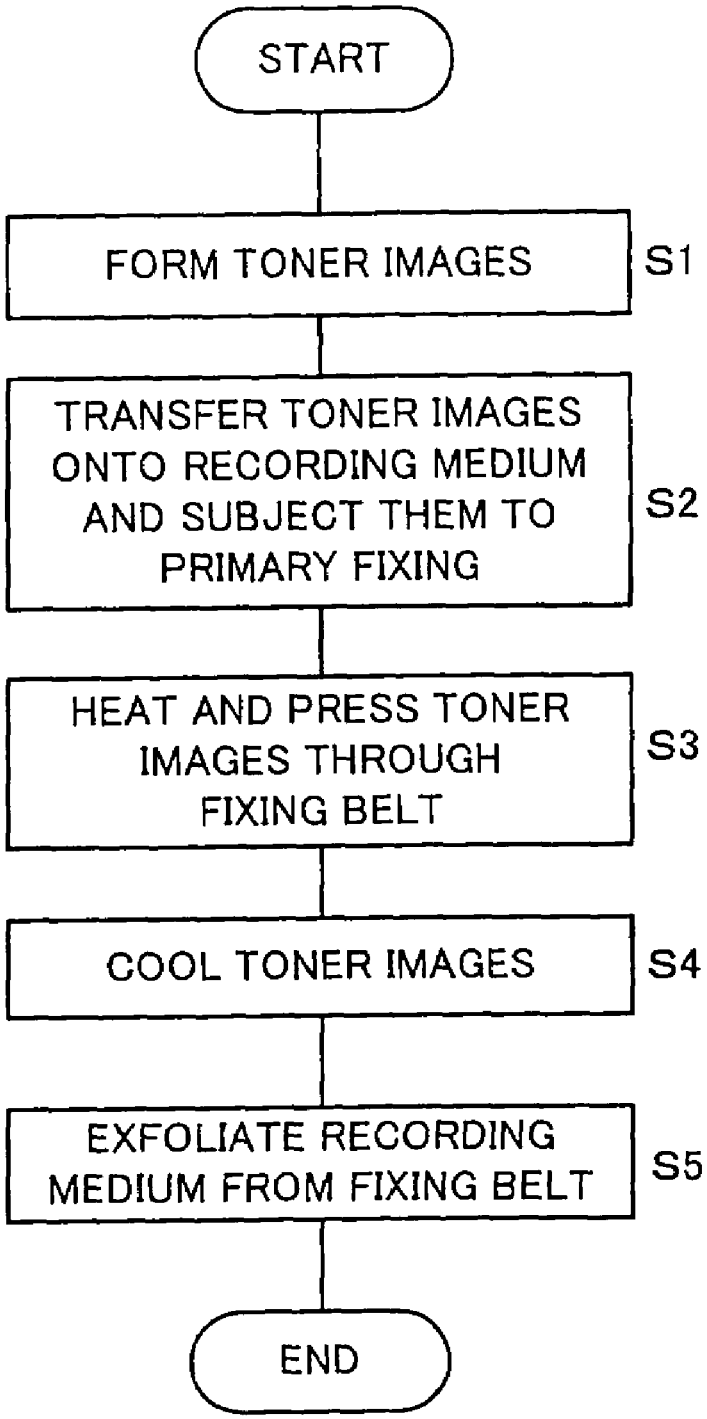
FIG. 2 is a flowchart showing an image forming operation of the image forming apparatus shown in FIG. 1.

FIG. 2 is a flowchart showing the image forming operation of the image forming apparatus shown in FIG. 1.

Electrostatic latent images are formed in each of the four image forming units 6K, 6C, 6M and 6Y in response to the laser beam irradiated from the exposure unit 7. The electrostatic latent images formed are developed with the toners of the respective colors, and thus toner images are formed. The thus formed toner images of the respective colors are overlapped by the intermediate transfer belt 5 so that a multi-color toner image is formed (step S1). The recording medium is taken out from the tray 1 in response to the formation of the multi-color toner image and carried by carriage rolls 3, and further the recording medium is aligned by a pair of sheet position alignment rolls 8. Then, in a pair of secondary transfer rolls 9, the multi-color toner image formed in step S1 is transferred onto the recording medium carried in and further primarily fixed in a primary fixing unit 10 (step S2). Then, the recording medium passes through a pair of feed rolls 13 and transported to the surface treatment unit 200.

The recording medium, onto which the toner images are primarily fixed and which is transported to the surface treatment unit 200, passes through a nip region formed in a position that the fixing belt 240 and the press roll 250 are pressed to contact with each other. While the recording medium passes through the nip region, the fixing belt 240 contacts closely with the toner image on the recording medium. The toner image is heated and and pressed such that the toner is melted (step S3). The recording medium is adhered to the fixing belt 240 through the melted toner and carried to the cooling heat sink 260 by the fixing belt 240 as it is. The cooling heat sink 260 cools the fixing belt 240 so that the surface temperature of the fixing belt 240 is set within the range of 50° C. or more to 80° C. or less. Through this cooling, the recording medium adhered to the fixing belt 240 is also cooled by so that the toners on the recording medium are solidified (step S4). After the toners are solidified, in the exfoliation roll 220, the recording medium is exfoliated from the fixing belt by the exfoliation roll 220 (step S5) and discharged to a discharge tray not shown in the drawing. The treatments from steps S3 to S5 correspond to a secondary fixing treatment.

An image forming method carried out by the image forming apparatus 1000 is as described above. In the image formation described above, when the toners melted on the fixing belt 240 is exfoliated from the fixing belt 240 after they are cooled, the toner image on the recording medium copies the surface shape of the fixing belt 240 as the recording medium molds the surface shape. As a result, the image formed is affected by the surface shape of the fixing belt 240. In particular, the glossiness of the image greatly depends on the surface shape of the fixing belt. When the surface shape of the fixing belt has irregularities, the glossiness of the image is reduced, whereas when the surface shape of the fixing belt is smooth, the glossiness of the image is increased. Accordingly, when the surface shape of the fixing belt has excessively irregularities, the image formed lacks glossiness, whereas when the surface shape of the fixing belt is excessively smooth, although glossiness is increased, the image is hard to see because reflected light from the surface of the image is excessively strong. Accordingly, to form an image in which the intensity of light reflected from the surface of the image is appropriately adjusted while the image requires glossiness as does a photographic image, it is preferable to use a fixing belt that has appropriate irregularities appearing on the surface with which the toner image contacts closely when the secondary fixing treatment is carried out. The fixing belt 240 has an arrangement to realize appropriate irregularities on the surface. The arrangement will be explained below.

Figure 3:
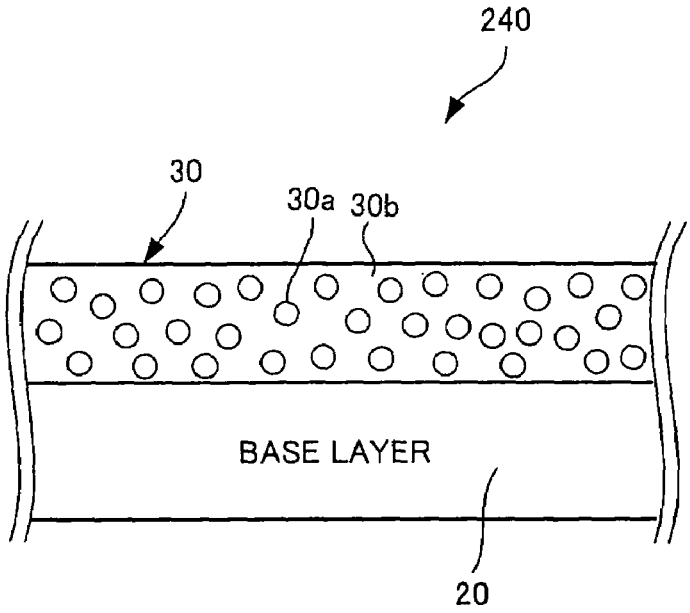
FIG. 3 is a constitutional view of a fixing belt of the first exemplary embodiment.

FIG. 3 is a constitutional view of the fixing belt of the first exemplary embodiment.

As shown in the drawing, the fixing belt 240 is composed of a base layer 20 and a fluorocarbon siloxane rubber layer 30 that overlaps on the base layer 20 and is composed of fluorocarbon siloxane rubber. When the secondary fixing treatment is carried out, the fluorocarbon siloxane rubber layer 30 contacts with the toner image on the recording medium. The fluorocarbon siloxane rubber layer 30 corresponds to an example of a surface layer according to an aspect of the invention.

The base layer 20 is obtained by processing polyimide that is a kind of a resin film to an endless-belt-like sheet having a circumference of 527.8 mm, a width of 140 mm, and a thickness of 75 μm. Polyimide is excellent in thermal stability and mechanical strength and has a property suitable for a material of the fixing belt.

The fluorocarbon siloxane rubber layer 30 is composed of first fluorocarbon siloxane rubber 30*b*, which mainly constitutes the layer, and particles of second fluorocarbon siloxane rubber 30*a* dispersed in the first fluorocarbon siloxane rubber 30*b*, the second fluorocarbon siloxane rubber 30*a* having a hardness different from that of the first fluorocarbon siloxane rubber 30*b*. The fluorocarbon siloxane rubber layer 30 has a film thickness of 40 μm.

In general, a wax with a low melting point is often contained in toner, and when the toner image is heated in the secondary fixing treatment described above, the wax is melted prior to the other components (colorants and the like) of the toner and adhered to the surface of the fixing belt, and the colorants and the like are melted on the wax. The toner image can be easily separated from the surface of the fixing belt by the use of the wax as described above after the secondary fixing treatment is carried out. However, as toner images are repeatedly subjected to the secondary fixing treatment many times, the wax may be sticked to the surface of the fixing belt as it is, and irregularities may be formed on the surface.

Since fluorocarbon siloxane rubber is a material to which wax is unlike to be sticked, a fixing belt having a surface on which irregularities are unlike to be formed can be realized by forming the fluorocarbon siloxane rubber layer 30 on the surface of the fixing belt 240 that contacts with the toner image on the recording medium. However, when only a layer composed of fluorocarbon siloxane rubber with a uniform hardness is provided, an image with high but monotonous glossiness is formed because the surface shape of the fixing belt becomes excessively smooth.

To cope with the above problem, the fluorocarbon siloxane rubber layer 30 is composed of two kinds of fluorocarbon siloxane rubbers each having a different hardness so that a toner image contacting closely with the fixing belt 240 receives a pressure with its depressed distribution from the surface of the fixing belt 240 in place of a uniform pressure. As a result, the surface of the toner image is not made to a flat surface and has appropriate irregularities formed on it.

The two kinds of the fluorocarbon siloxane rubbers, that is, the first fluorocarbon siloxane rubber 30*b* and the second fluorocarbon siloxane rubber 30*a* have the same chemical composition and an approximately the same synthesizing method. However, the second fluorocarbon siloxane rubber 30*a* is formed to a particle shape by emulsifying a fluorocarbon siloxane rubber precursor and then heating the precursor. The particles of the second fluorocarbon siloxane rubber 30*a* preferably have a volume average particle diameter of about 1 μm or more to about 450 μm or less in view of the life of a member composed of it and the affect of it to image quality. When the particle diameter is greater than 450 μm, the particles are liable to remove from the layer depending on a condition of use and have a tendency of damaging a maintenance property. In particular, when the particle diameter is larger than 1.5 times the layer to be arranged, this tendency becomes outstanding. When the particle diameter is less than 1 μm, an effect of realizing an aimed effect is less than a visually recognizable magnitude, and thus there is a tendency that achievement of an object is difficult.

This particles of the second fluorocarbon siloxane rubber 30*a* mixedly exist in the first fluorocarbon siloxane rubber 30*b*, such as a ratio that 30 parts by weight of the second fluorocarbon siloxane rubber 30*a* to 100 parts by weight of the first fluorocarbon siloxane rubber 30*b*, for example.

The amount of addition of the particles of the second fluorocarbon siloxane rubber 30*a* to the first fluorocarbon siloxane rubber 30*b* is not limited to the above ratio, and it is preferable that 50 parts by weight or less to 1 part by weight or more of the second fluorocarbon siloxane rubber 30*a* mixedly exist in 100 parts by weight of the first fluorocarbon siloxane rubber in view of the life of the member and the affect to image quality. When the amount of addition is more than 50 parts by weight, since the particles of the second fluorocarbon siloxane rubber 30*a* come into contact with each other more often, there is a tendency that it is difficult to maintain the shape of the rubber as the rubber layer. When the amount is less than 5 parts by weight, since a surface layer is made excessively smooth and light reflected from the surface of an image is strong, a created photographic image is hard to see. Accordingly, it is difficult to realize the aimed effect and thus there is a tendency that it is difficult to achieve the object.

The hardness of the second fluorocarbon siloxane rubber 30*a* is about A10/S or more over than the hardness of the first fluorocarbon siloxane rubber 30*b* in terms of JIS-A hardness.

Further, in the fluorocarbon siloxane rubber layer of the first exemplary embodiment, the hardness of the second fluorocarbon siloxane rubber 30*a* is about A10/S or more than the hardness of the first fluorocarbon siloxane rubber 30*b* in terms of JIS-A hardness. However, in the surface layer the first exemplary embodiment of the present invention, the hardness of the second fluorocarbon siloxane rubber 30*a* may be about A10/S or less than the hardness of the first fluorocarbon siloxane rubber 30*b* on the contrary. The difference between the hardnesses is preferably about A5/S or more and more preferably about A10/S or more.

The chemical composition of fluorocarbon siloxane rubber that constitutes the fluorocarbon siloxane rubber layer 30 will be explained below.

The rubber called by the name of fluorocarbon siloxane rubber is a cured material of a precursor composition having the following components (A) to (E). The first fluorocarbon siloxane rubber 30*b* and the particles of the second fluorocarbon siloxane rubber 30*a*, which are described above, are cured materials of the precursor composition and have the same composition although they have a different hardness each.

(A) Fluorocarbon polymer mainly composed of fluorocarbon siloxane having a repeated unit shown by the following general structural formula (1) and an aliphatic unsaturated group (1)

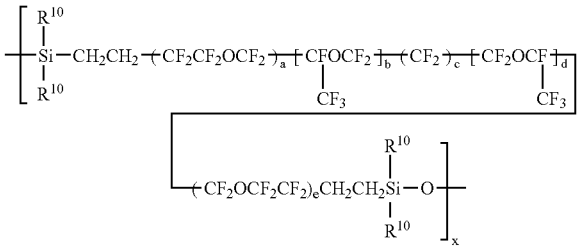

(in the formula, $R^{10}$ shows an unsubstituted or substituted monovalent hydrocarbon group, x shows an integer of 1 or more, a, e shows 0 or 1, respectively, b, d show integers of 1 to 4, respectively, and c shows an integer of 0 to 8)

(B) Organopolysiloxane and/or fluorocarbonsiloxane which contains two or more ═SiH groups in one molecule and in which the mol content of the ═SiH groups is one to four times the amount of an aliphatic unsaturated group in the fluorocarbon siloxane rubber composition, or which contains one or more of either a perfluoroalkyl group bonded to a silicon atom through a carbon atom or a perfluoroalkyl group (C) Filler (D) Effective Amount of Catalyst (E) Organic silicon compound which contains two or more hydrogen atoms bonded to silicon atoms, and which contains one or more of monovalent perfluorooxyalkyl group(s) or monvalent perfluoroalkyl group(s) or bivalent perfluorooxyalkyl group(s) or bivalent oxyalkyl group(s) in a molecule.

The fluorocarbon siloxane rubber layer 30 employs the fluorocarbon polymer shown in the following formula (2) or (3) as the fluorocarbon polymer composed of the (A) component.

(2)

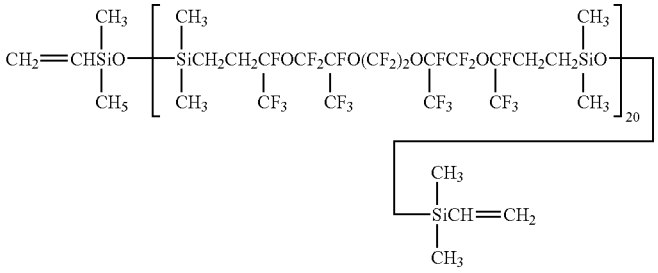

(3)

[In the formula, X shows a group shown by —$CH_2$— or —$CH_2O$— or —$CH_2OCH_2$— or —Y—$NR^1$—CO— (Y represents —$CH_2$— or an o/m/p-dimethyl silylphenylene group shown by the following formula (Z)), (Z)

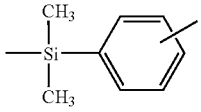

$R^1$ shows a hydrogen atom, or an unsubstituted or substituted monovalent hydrogen group, X' shows a group shown by —$CH_2$— or —$OCH_2$— or —$CH_2OCH_2$— or —CO—$NR^1$—Y'— (Y' shows —$CH_2$— or an o/m/p-dimethyl silylphenylene group shown by the following formula (Z')

(Z')

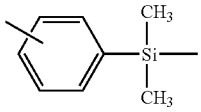

$R^1$ is the same group as the one described above. $Rf^1$ shows a bivalent perfluoro polyether group, and a shows independently 0 or 1.] At this point, $Rf^1$ in the general formula described above shows a perfluoro polyether structure, and shows a compound shown by the following general formulas (i) and (ii). A straight chain fluoro polyether compound shown by these formulas.

(i)

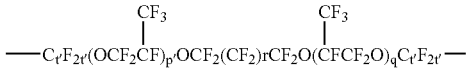

(in the formulas, p' and q show integers of 1 to 150, and the averaged sum of p' and q shows 2 to 20. r shows an integer 0 to 6, and t' shows 2 or 3.)

(ii)

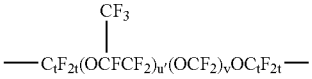

(in the formula, U' shows an integer of 1 to 200, v shows an teteger of 1 to 50, and t shows the same as the one described above.)

Further, the fluorocarbon siloxane rubber layer 30 employs organo-hydrogen-polysiloxane having at least two hydrogen atoms bonded to a silicon atom in a molecule as the (B) component. A cured material is formed by an addition reaction generated between the hydrogen atoms bonded to the silicon atom in the organo-hydrogen-polysiloxane and the aliphatic unsaturated group in the fluorocarbon siloxane. Although there are several kinds of organo-hydrogen-polysiloxanes, the fluorocarbon siloxane rubber layer 30 employs the following (α) and (β) organo-hydrogen-polysiloxanes.

(α) Organo-Hydrogen-Polysiloxanes shown by the following formulas (4) to (6)

(4)

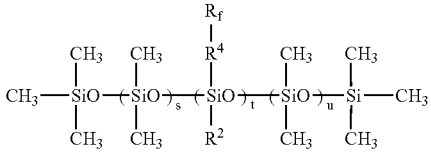

(5)

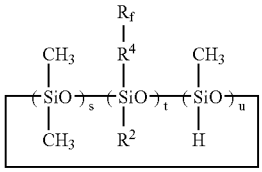

(6)

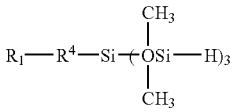

In the above formulas, s and t show integers of 0 or more, and u shows an integer of 2 or more. Further, $R^2$ shows an unsaturated or saturated monovalent hydrocarbon groups having no aliphatic unsaturated bond, and the hydrocarbon group preferably has the number of carbons of 1 to 12 and more preferably 1 to 8. Specifically exemplified are alkyl groups such as a methyl group, ethyl group, isopropyl group, butyl group, and the like, cycloalkyl groups such as a cyclohexyl group, cyclopenthyl group, and the like, aryl groups such as a phenyl group, tolyl group, xylyl group, and the like, aralkyl groups such a benzyl group, phenylethyl group, and the like, halogenated hydrocarbon groups such as a chloromethyl group, chloropropyl group, chlorocyclohexyl group, 3,3,3-trifluoropropyl group, and the like, and cyanohyrocarbon groups such as a 2-cyanoethyl group, and the like. Among these groups, the methyl group, ethyl group, phenyl group, and 3,3,3-trifluoropropyl group are particularly preferable. $R^4$ shows a bivalent group interposed between a silicon atom and a fluorine-containing organic group Rf, that is, a bivalent hydrocarbon group having no aliphatic unsaturated bond or a bivalent hydrocarbon group having an ether group shown by a general formula $—R^5—O—R^6—$ (in which $R^5$ and $R^6$ are bivalent hydrocarbon groups having no aliphatic unsaturated bond), and they preferably have the number of carbons of 1 to 8. Specifically, the following compositions are exemplified.

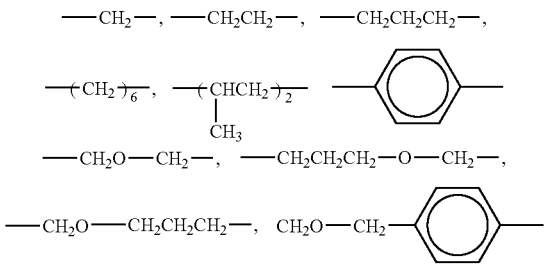

Note that, among R4, particularly preferable groups are $—CH_2CH_2—$, $—CH_2CH_2CH_2—$, and $—CH_2CH_2CH_2—O—CH_2—$. $R_f$ shows a perfluoroalkyl group or perfluoroalkylether group. Groups shown by a formula $C_pF_{2p+1}$ (wherein, $_p$ shows an integer of 4 to 10) are exemplified as the perfluoroalkyl group, and particularly preferable groups are $C_6F_{13}—$, $C_8F_{17}—$, and $C_{10}F_{21}—$. Group having the number of carbons of 5 to 15 are preferable as the perfluoroalkylether group, and the following groups are specifically exemplified.

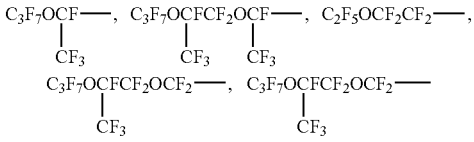

(β) Copolymer composed of a $(CH_3)_2HSi_{0.5}$ unit and a $SiO_2$ unit shown below

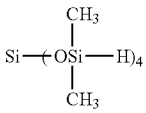

(7)

Note that the viscosity of organo-hydrogen-polysiloxane at 25° C. is 20,000 cP or less, and the ≡SiH groups of it are blended at such a ratio that the number of them is 1 to 5 to one aliphatic unsaturated hydrocarbon group in the fluorocarbon siloxane of (A) component.

Further, the fluorocarbon siloxane rubber layer 30 may employ various kinds of fillers which are used in a general silicon rubber composition as a filler of the (C) component. As such fillers, reinforcing fillers such as aerosol silica, precipitated silica, carbon black, carbon powder, talc, sericite, bentonite and the like and fiber fillers such as asbestos, glass fiber, organic fiber and the like are exemplified. Carbon powder is employed in the fluorocarbon siloxane rubber layer 30 employs carbon powder as a filler of the (C) component. About 1 part by weight or more to about 200 parts by weight or less of the filler are blended with 100 parts by weight of (A) component.

Further, the fluorocarbon siloxane rubber layer 30 shown in FIG. 3 uses, as a catalyst of the (D) component, a widely known catalyst as far as the catalyst causes the components described in the components (A) and (B) to react together to accelerate curing by heating and for example, employs choropplatinic acid, which is an addition reaction catalyst, as a catalyst of the (D) component. The blending quality of the platinic acid chloride platinum group metal catalyst is about 5 ppm or more to 20 ppm or less in terms of platinum group metal to 100 parts by weight of the (A) component.

Further, SIFEL made by Shin-Etsu Chemical Co., Ltd. may be exemplified as a fluorocarbon siloxane rubber composition containing materials shown in the (A), (B), (D) and (E) components. According to an aspect of the invention, while such a material on the market may be used as a fluorocarbon siloxane rubber composition as it is, it is preferable to use a fluoro siloxane composition in which a filler shown in the component (C) is mixed as the need arises.

Next, it will be explained that appropriate irregularities can be formed on the surface of a toner image after it is subjected to the secondary fixing treatment by providing the fixing belt 240 with the arrangement shown in FIG. 3 based on specific examples in which the fixing belts are made and an image is formed using them.

In the specific examples explained below, the fixing belts of examples 1 to 4 each having a fluorocarbon siloxane rubber layer in which two kinds of fluorocarbon siloxane rubbers mixedly exist and fixing belts of comparative examples 1 and 2 each having a fluorocarbon siloxane rubber layer composed of one kind of fluorocarbon siloxane rubber are employed.

Note that the JIS-A hardness described above is used as a hardness, and hardness is measured for 6 mm thick samples formed of a rubber material using a durometer ASKER type A made by Kobunshi Keiki Co., Ltd. according to JIS-K 6532 (1997).

First, the fixing belt of the example 1 will be explained.

(1) Manufacture of Fluorocarbon Siloxane Rubber Particles 50 parts by weight of SIFEL 604 (made by Shin-Etsu Chemical Co., Ltd.), which is a precursor composition containing the (A) to (D) components described above and having a hardness (JIS-A hardness) of A48/S, are prepared. A diluted solution that the 50 parts by weight of SIFEL 604 are adjusted by 100 parts by weight of a fluorine solvent (mixed solvent composed of m-xylene hexafluoride, perfluoroalkan, and perfloro (2-butyltetrahydrofuran) is mixed with 150 parts by weight of distilled water and emulsified by a Ultra-Tarax T-25 (made by IKA Japan Corp.) at 12000 rpm. At the same time, the liquid is heated from a room temperature to 90° C., thereby particles having a volume average particle diameter of 20 μm are obtained.

(2) Formation of Base Layer

Belt-shaped polyimide having a circumference of 527.8 mm, a width of 140 mm, and a thickness of 75 μm is prepared as a belt-shaped base member. The polyimide is added with carbon black so that its volume resistivity is adjusted to $Rv=10^{12}$ Ωcm to form a polyimide base layer.

(3) Formation of Fluorocarbon Siloxane Rubber Layer 100 parts by weight of SIFEL 610 (made by Shin-Etsu Chemical Co., Ltd.) that is a precursor composition containing the (A) to (D) components described above and having a hardness (JIS-A hardness) of A34/S are prepared likewise SIFEL 604 (made by Shin-Etsu Chemical Co., Ltd.). A solution, which is composed of 100 parts by weight of SIFEL 610, 30 parts by weight of the particles of SIFEL 604 (made by Shin-Etsu Chemical Co., Ltd.) made in (1) and 30 parts by weight of a fluorine solvent (mixed solvent composed of m-xylene hexafluoride, perfluoroalkan, and perfloro (2-butyltetrahydrofuran), is made, and the solution as a coating liquid is dip coated on the polyimide base layer formed in (2) by a dip coating method, and a coated film is formed. Then, the base layer is subjected to primary vulcanization for 10 minutes at 120° C. and further subjected to secondary vulcanization for 4 hours at 200° C. After this job is carried out, a fixing belt having a 40 μm thick fluorocarbon siloxane rubber layer is obtained. This is the fixing belt of the example 1.

Although the dip coating method is employed, methods such as a blade coating method, wire bar coating method, ring coating method, spray coating method, flow coating method, bead coating method, air knife coating method, curtain coating method, and the like can be employed, in addition to the dip coating method. Further, a coating liquid, which is obtained by diluting the above coating liquid with solvents such as m-xylene hexafluoride, perfluoroalkan, perfloro(2-butyltetrahydrofuran), benzotrifluoride, and the like may be used so that the coating liquid has an appropriate viscosity.

(4) Formation of Image

When the fixing belt of the example 1 is attached as the fixing belt 240 of the image forming apparatus shown in FIG. 1 and a full color image is formed, an image having appropriate irregularities on the surface of it can be obtained.

Subsequently, the fixing belt of the example 2 will be explained.

(1) Manufacture of Fluorocarbon Siloxane Rubber Particles 50 parts by weight of SIFEL 604 (made by Shin-Etsu Chemical Co., Ltd.) used in the example 1 and having a hardness (JIS-A hardness) of A48/S are prepared. A diluted solution that the 50 parts by weight of SIFEL 604 are mixed with a diluted solution adjusted by 80 parts by weight of a fluorine solvent (mixed solvent composed of m-xylene hexafluoride, perfluoroalkan, and perfloro(2-butyltetrahydrofuran) is mixed with 150 parts by weight of distilled water and emulsified by a Ultra-Tarax T-25 (made by IKA Japan) at 8000 rpm. At the same time, the liquid is heated from a room temperature to 90° C., thereby particles having a volume average particle diameter of 40 μm are obtained.

When the fixing belt of the example 2 is made using the particles likewise the example 1 and attached as the fixing belt 240 of the image forming apparatus shown in FIG. 1 and a full color image is formed, an image having appropriate irregularities on the surface of it can be obtained.

Subsequently, the fixing belt of the example 3 will be explained.

In the example 3, fluorocarbon siloxane rubber particles are made in (1) of the example 1 by the same method as (1) of the example 1 using SIFEL 614 (made by Shin-Etsu Chemical) having a hardness (JIS-A hardness) of A25/S in place of SIFEL 604 (made by Shin-Etsu Chemical). Accordingly, the example 3 is different from the example 1 in that the hardness of the fluorocarbon siloxane rubber particles is lower than that of the fluorocarbon siloxane rubber (SIFEL 610 (made by Shin-Etsu Chemical)) as a main component. The fixing belt is made using the fluorocarbon siloxane rubber particles through the same steps as (2) and (3) of the example 1, and an image is formed likewise (4) of the example 1. An image having appropriate irregularities on the surface of it can be obtained also by the fixing belt of the example 3.

Subsequently, the fixing belt of the example 4 will be explained.

In the example 4, fluorocarbon siloxane rubber particles are made in (1) of the example 1 by the same method as (1) of the example 1 using SIFEL 620 (made by Shin-Etsu Chemical) having a hardness (JIS-A hardness) of A90/S in place of SIFEL 604 (made by Shin-Etsu Chemical). Further, after a base layer is formed by the same step as (2) of the example 1, in (3) of the example 1, the fixing belt is made through the same step as (3) of the example 1 using SIFEL 604 (made by Shin-Etsu Chemical) described above in place of SIFEL 610 (made by Shin-Etsu Chemical). In the example 4, the hardness of the fluorocarbon siloxane rubber particles is much higher than that of fluorocarbon siloxane rubber (SIFEL 610 (made by Shin-Etsu Chemical)) as a main component. An image is formed by the fixing belt made likewise (4) of the example 1. An image having appropriate irregularities on the surface can be obtained also by the fixing belt of the example 4.

Subsequently, the fixing belt of the comparative example 1, which is compared with the fixing belts of the examples 1 to 4, will be explained.

In the comparative example 1, particles having a volume average particle diameter of 20 μm are made by replacing the fluorocarbon siloxane rubber of (1) of the example 1 to SIFEL 610, and the fixing belt is made through the same steps as the steps (2) and (3) of the example 1. Then, an image is formed likewise (4) of the example 1. The image formed by the fixing belt of the comparative example 1 has a monotonous surface without irregularities.

Subsequently, the fixing belt of the comparative example 2 will be explained.

In the comparative example 2, the fixing belt is made likewise the example 1 using SIFEL 604 (made by Shin-Etsu Chemical Co., Ltd.) in place of SIFEL 610 (made by Shin-Etsu Chemical Co., Ltd.) used in (3) of the example 1. When an image is formed likewise (4) of the example 1, the formed image has a monotonous surface without irregularities.

It is verified from the above result that appropriate irregularities are formed on the surface of toner images by adding the particles of fluorocarbon siloxane rubber (the second fluorocarbon siloxane rubber 30*a* described above) having a different hardness to fluorocarbon siloxane rubber (the first fluorocarbon siloxane rubber 30*b* described above) as the main component in the fluorocarbon siloxane rubber layer.

As described above, a high quality image having delicate irregularities, which are required as photographic quality, on the surface of it can be obtained by providing the fixing belt having the arrangement as shown in FIG. 3.

The first embodiment has been explained as described above.

Second Exemplary Embodiment

In the first exemplary embodiment described above, the fixing belt 240 has the two-layer arrangement in which the fluorocarbon siloxane rubber layer 30 overlaps on the base layer 20. However, the belt member of second exemplary embodiment according to an aspect of the invention can also employ a three-layer arrangement in which a silicon rubber layer overlaps on the a base layer 20 and a fluorocarbon siloxane rubber layer 30 overlaps on the silicon rubber layer. A fixing belt having the above arrangement will be explained below.

Figure 4:
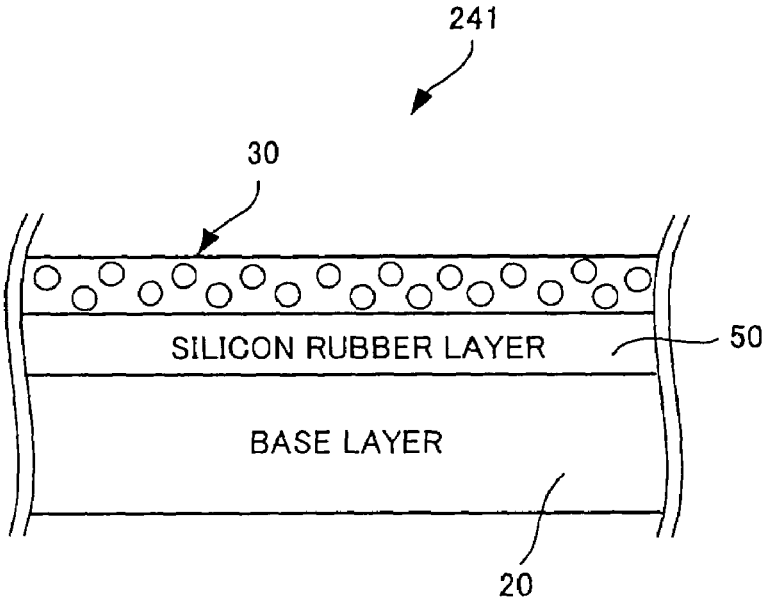
FIG. 4 is a constitutional view of a fixing belt having a silicon rubber layer.

FIG. 4 is a constitutional view of the fixing belt having the silicon rubber layer.

As shown in the figure, in the fixing belt 241 of the second embodiment, the silicon rubber layer 50 composed of dimethyl silicon rubber overlaps on the base layer 20 having a circumference of 527.8 mm, a width of 140 mm, and a thickness of 75 μm, and the fluorocarbon siloxane rubber layer 30 overlaps on the silicon rubber layer 50. The silicon rubber layer 50 is formed by coating a coating liquid having a precursor composition of silicon rubber and curing it. In the fixing belt 241 of the second embodiment, the thickness of the silicon rubber layer 50 is 25 μm, and the thickness of the fluorocarbon siloxane rubber layer 30 is 15 m. Accordingly, the sum of the thicknesses of the silicon rubber layer 50 and the fluorocarbon siloxane rubber layer 30 is 40 μm and is the same as that of the fluorocarbon siloxane rubber layer 30 of the first embodiment. However, the thickness of the fluorocarbon siloxane rubber layer 30 of the second embodiment is made smaller than that of the first embodiment by the provision of the silicon rubber layer 50.

In general, fluorocarbon siloxane rubber is more expensive than silicon rubber. In the fixing belt 241 of the second embodiment, a portion more than lower half of the fluorocarbon siloxane rubber layer 30 in FIG. 3 is replaced with the silicon rubber layer 50 while maintaining the thickness of the fluorocarbon siloxane rubber layer 30 necessary to form appropriate irregularities on the surface of an image. As a result, when the toner image come is pressed on the fixing belt 241, the silicon rubber layer plays a main role as an elastic material in place of the fluorocarbon siloxane rubber layer 30. With this arrangement, the cost of the fixing belt 241 of the second embodiment can be reduced by the above arrangement.

Further, in general, silicon rubber is superior to fluorocarbon siloxane rubber in strength and heat resistance. Therefore, the strength and heat resistance of the fixing belt 241 of the second embodiment are enhanced by making the thickness of the silicon rubber layer 50 (25 μm) larger than the thickness of the fluorocarbon siloxane rubber layer 30 (15 μm) overlapping on it.

Third Exemplary Embodiment

In the first exemplary embodiment, the fixing belt 240 has the two-layer arrangement in which the fluorocarbon siloxane rubber layer 30 overlaps on the base layer 20 as it is. In the belt member of third exemplary embodiment according to an aspect of the invention, however, an adhesive layer may be interposed between the base layer 20 and the fluorocarbon siloxane rubber layer 30 to enhance the sticking property between the base layer 20 and the fluorocarbon siloxane rubber layer 30. A fixing belt having the above arrangement will be explained below.

Figure 5:
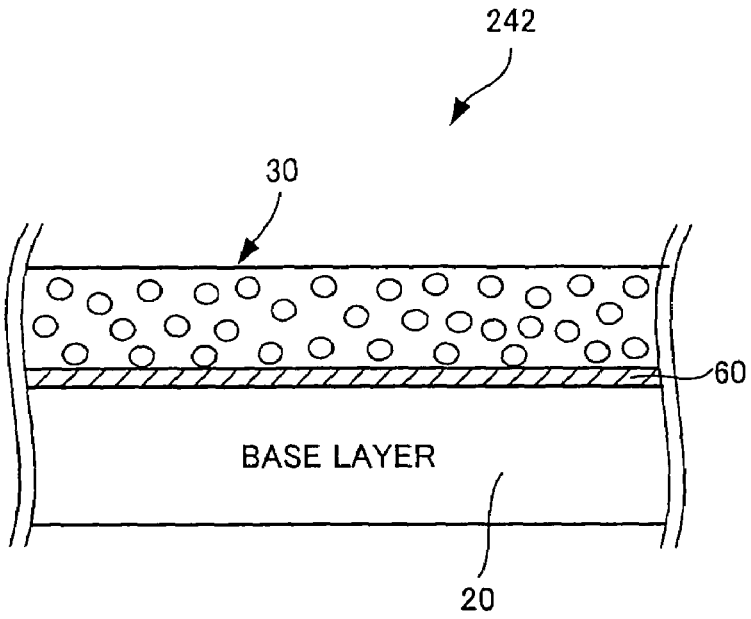
FIG. 5 is a constitutional view of a fixing belt having an adhesive layer interposed between a base layer and a fluorocarbon siloxane rubber layer.

FIG. 5 is a constitutional view of the fixing belt having an adhesive layer interposed between a base layer and a fluorocarbon siloxane rubber layer.

As shown in the figure, the fixing belt 242 of the third embodiment has the adhesive layer 60 containing an aminosilane coupling agent and interposed between the base layer 20 and the fluorocarbon siloxane rubber layer 30, the base layer 20 having a circumference of 527.8 mm, a width of 140 mm, and a thickness of 75 μm. The thickness of the adhesive layer 60 is sufficiently smaller than that of the fluorocarbon siloxane rubber layer 30, and the sum of the thicknesses of the fluorocarbon siloxane rubber layer 30 and the adhesive layer 60 is 40 μm. In the fixing belt 242 of the third embodiment, the sticking property of the base layer 20 to the fluorocarbon siloxane rubber layer 30 is enhanced by the provision of the adhesive layer 60 as described above.

Fourth Exemplary Embodiment

In the fixing belt 240 of the third exemplary embodiment, the fluorocarbon siloxane rubber layer 30 overlaps on the base layer 20 with the adhesive layer 60 interposed between them. In the belt member of fourth exemplary embodiment according to an aspect of the invention, the silicon rubber layer may overlap on the base layer through the adhesive layer 60 interposed between them and further the fluorocarbon siloxane rubber layer 30 may overlaps on the silicon rubber layer. A fixing belt having the above arrangement will be explained below.

Figure 6:
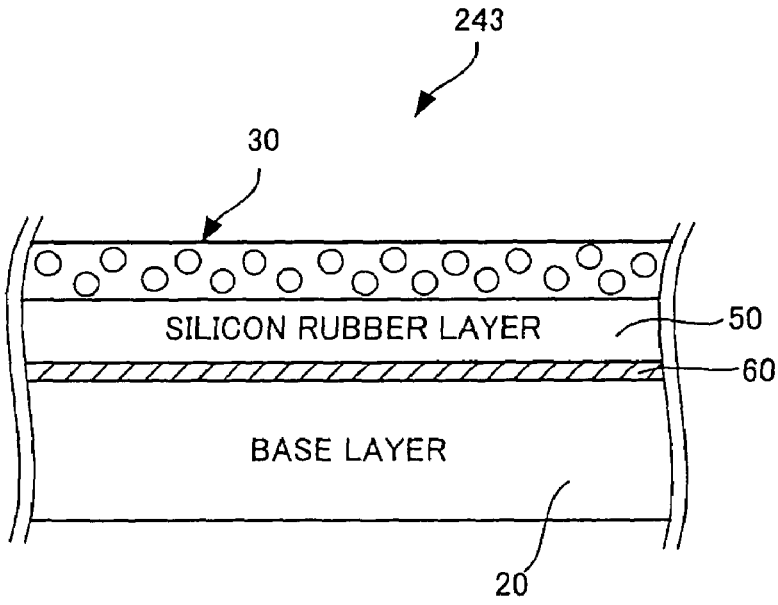
FIG. 6 is a constitutional view of a fixing belt having a four-layer arrangement composed of a base layer, an adhesive layer, a silicon rubber layer, and a fluorocarbon siloxane rubber layer.

FIG. 6 is a constitutional view of a fixing belt having a four-layer arrangement composed of a base layer, the adhesive layer, the silicon rubber layer, and the fluorocarbon siloxane rubber layer.

As shown in the drawing, the fixing belt 243 of the fourth examplary embodiment has the four-layer arrangement in which the silicon rubber layer 50 overlaps on the base layer 20 with the adhesive layer 60 containing an aminosilane coupling agent interposed between them, and further the fluorocarbon siloxane rubber layer 30 overlaps on the silicon rubber layer 50, wherein the base layer 20 has a circumference of 527.8 mm, a width of 140 mm, and a thickness of 75 μm. The sum of the thicknesses of the silicon rubber layer 50, the adhesive layer 60, and the fluorocarbon siloxane rubber layer 30 is 40 μm, the thickness of the silicon rubber layer 50 is larger than that of the fluorocarbon siloxane rubber layer 30, and the thickness of the adhesive layer 60 is sufficiently smaller than those of the silicon rubber layer 50 and the fluorocarbon siloxane rubber layer 30.

With the above arrangement, the sticking property between the base layer 20 and the silicon rubber layer 50 can be enhanced, the strength and heat resistance of the fixing belt 243 can be increased, and the cost of the fixing belt 243 can be reduced.

The embodiments according to an aspect of the invention have been explained as described above.

In the example explained above, the fixing belt 240 is stretched by the three rolls, that is, the heat roll 210, the exfoliation roll 220, and the meandering control roll 230. In the invention, however, a tension roll with a small diameter may be disposed between the cooling heat sink 260 and the heat roll 210 to apply a predetermined tension to the fixing belt 240. Further, in the invention, a mold lubricant composed of dimethyl silicone oil may be coated on the surface of the fixing belt 240 to easily exfoliate the toner image from the surface of the fixing belt 240 when the secondary fixing treatment is carried out. Further, a mold lubricant supplier may be provided to supply the mold lubricant to the surface of the fixing belt 240.

Further, in the embodiments explained above, although the aluminum core metal is used as the core metal of the press roll 250 and the heat roll 210, a stainless core metal may be used in the invention. Any of the elastic layers of the press roll 250 and the heat roll 210 is preferably an elastic layer whose hardness is within the range of about A20/S or more to about A60/S or less in terms of JIS-A hardness. In the embodiments described above, the halogen lamp in the heat roll 210 and the halogen lamp in the press roll 250 have power consumption of 320 W and 300 W, respectively. In the invention, however, halogen lamps having power consumption within the range of about 300 W or more to about 350 W or less are preferable. It is preferable that the surface temperature of the heat roll be kept constant within the range of about 130° C. or more to about 195° C. or less, and the surface temperature of the press roll be kept constant within the range of about 85° C. or more to about 155° C. or less. Further, in the invention, the press roll may carry out only pressurization without being provided with the halogen lamp as a heat source.

Although the base layer is composed of polyimide in the embodiments explained above, the base layer of the invention may be a metal sheet composed of nickel, aluminum, stainless, and the like or a resin film composed of PET, PBT, polyimide, polyimideamide, and the like. When the resin film is used, the resistivity ratio of the base layer may be controlled by dispersing conductive powder and carbon black in the resin film. The thickness of the base layer of the invention is preferably within the range of about 20 μm or more to about 200 μm or less, more preferably within the range of about 30 μm or more to about 150 μm or less, and further more preferably within the range of about 40 μm or more to about 130 μm or less. When the thickness of the base layer is less than 20 μm, it lacks dimensional stability and strength when it is heated and cooled. Whereas, when the thickness exceeds 200 μm, the speed of heat conduction from the fixing belt is reduced, leading to a reduction of a transfer speed and a cycle time.

In the fluorocarbon siloxane rubber layer of the examples explained above, the fluorocarbon polymer shown by the formula (2) described above is used as the fluorocarbon polymer composed of the (A) component. In the surface layer of the invention, the fluorocarbon polymer composed of the (A) component may be a fluorocarbon polymer having alkenyl groups with the number of carbons of 2 to 3 such as a vinyl group, allyl group, ethyl group, and the like, each of which is a monovalent aliphatic unsaturated hydrocarbon group, to a molecule chain-end and having a vinyldialkylsilyl group, divinylalkylsilyl group, trivinylsilyl group to a main-chain. Note that the number of carbons of an alkyl group in this case is preferably 1 to 8, and a methyl group is particularly preferable. Further, in the above general structural formula (1) showing fluorocarbon siloxane, $R^{10}$ is preferably monovalent hydrocarbon having the number of carbons of 1 to 8, and an alkyl group having the number of carbons of 1 to 8 or an alkenyl group having the number of carbons of 2 to 3, for example, are preferable. A methyl group is particularly preferable.

Further, the fluorocarbon siloxane rubber layer of the examples explained above employs organo-hydrogen-polysiloxane having at least two hydrogen atoms bonded to a silicon atom in a molecule as the (B) component. However, in the surface layer of the invention, fluorocarbon siloxane having a ═SiH may be used as the (B) component. What is preferable as the fluorocarbon siloxane is such that $R^{10}$ is preferably a dialkylhydrogensiloxy group in the unit of the above formula (1) or in the above formula (1) as well as its terminal end is SiH groups such as a dialkylhydrogensiloxy group, a silyl group, or the like, and the component indicated by the following formula (8) may be exemplified.

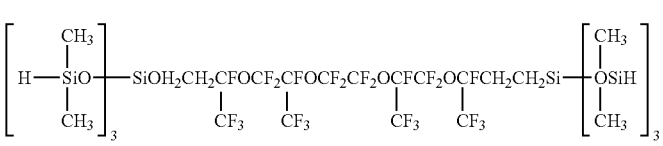

(8)

Further, the fluorocarbon siloxane rubber layer of the examples explained above employs carbon powder as the filler composed of the (C) component. However, the surface layer of the invention can employ various kinds of fillers that are generally used as the components of silicon rubber, in addition to the carbon powder. There can be employed, for example, reinforcing fillers such as aerosol silica, precipitated silica, titanium dioxide, aluminum oxide, quartz powder, talc, sericite, bentonite, and the like and fiber fillers such as asbestos, glass fiber, organic fiber, and the like. These fillers must be blended in an amount of about 0.1 part by weight or more to about 300 parts by weight or less to 100 parts by weight of the (A) component. When the fillers are blended in an amount of less than 0.1 part by weight, a sufficient reinforcing effect cannot be obtained, whereas when they are blended in an amount exceeding 300 parts by weight, there is a possibility that the mechanical strength of a cured material is deteriorated.

Further, the fluorocarbon siloxane rubber layer of the examples explained above employs chloroplatinic acid as the catalyst composed of the (D) component. In the surface layer of the invention, however, there may be employed the elements in Group VIII of the periodic table such as alcohol-denatured chloroplatinic acid, a complex of chloroplatinic acid and olefin, platinum black or palladium carried by a carrier such as alumina, silica, carbon, or the like, a complex of rhodium and olefin, chlorotris (triphenylphosphine) rhodium (Wilkinson's Catalyst), rhodium (III) acetylacetonato, and the like and compounds of them, in addition to the chloroplatinic acid. In the above components, it is preferable that the complexes be dissolved in a solvent of alcohol, ether, hydrocarbon, and the like for use. Although it is sufficient that the amount of blend of the platinum group metal catalyst be the effective amount of the catalyst, ordinarily, the amount of blend is preferably about 1 ppm or more to about 500 ppm or less and particularly preferably about 5 ppm or more to about 200 ppm or less to 100 parts by weight of (A) component in terms of platinum group metal.

In the surface layer of the invention, the amount of the second fluorocarbon siloxane rubber 30*a* to be added to 100 parts by weight of the first fluorocarbon siloxane rubber 30*b* is preferrably about 1 part by weight or more to about 50 parts by weight or less and particularly preferably 5 parts by weight or more to 35 parts by weight or less. Further, the surface layer of the invention may be composed of fluorocarbon siloxane rubber to which various blending agents are added. There may be added, for example, dispersing agents such as diphenylsilanediol, dimethylpolysiloxane which has a low degree of polymerization and in which terminal hydroxyl groups are blocked, hexamethyldisilazane, and the like, heat resistance improving agents such as ferrous oxide, ferric oxide, serium oxide, iron octylate, and the like, colorants such as pigment and the like, etc.

In the invention, the thickness of the layers other than the base layer (when there are three layers other than the base layer as in the fourth example, the sum of the thicknesses of the three layers) is preferably about 300 μm or less, more preferably within the range from about 1 μm or more to about 300 μm or less, furthermore preferably about 5 μm or more to about 200 μm or less, and still more preferably within the range from about 10 μm or more to about 100 μm or less. When the thickness is less than 1 μm, the fixing belt is liable to be worn due to lack of elasticity. Whereas, when the thickness exceeds 300 μm, the speed of heat conduction from the fixing belt is reduced, by which a transfer speed and a cycle time are reduced. Further, in the rubber layers functioning as an elastic member such as the fluorocarbon siloxane rubber layer and the silicon rubber layer, the average hardness of the overall rubber layer is preferably within the range from about A5/S or more to about A80/S or less, more preferably within the range from about A10/S or more to about A70/S or less, and still more preferably within the range from about A20/S or more to about A60/S or less in terms of JIS-A hardness. The rubber layer whose hardness is less than A5/S is defective in durability because the strength of it is reduced. Further, when the hardness exceeds A80/S in terms of JIS-A hardness, since rigidity is increased regardless of the thickness of the layers other than the base layer, the sticking property between the fixing belt and the recording medium is reduced and the recording medium is exfoliated from the fixing belt when cooling is not carried out completely, and then image quality is deteriorated.

In the fluorocarbon siloxane rubber layers of the second and fourth examples, dimethyl silicon rubber is employed as the component of the silicon rubber. However, methyl vinyl silicon rubber, methyl phenyl silicon rubber, fluorosilicon rubber, and the like may be employed, as the component of the silicon rubber of the invention, in addition to dimethyl silicon rubber. These silicon rubbers may be made by a heat/vulcanization (HTV) system or a room temperature curing (RTV) system. Further, they may be polymerized by any of addition polymerization and condensation polymerization.

Further, the aminosilane coupling agent is employed as the component of the adhesive layers of the third and fourth examples. However, primers and the like, which are ordinarily used to adhesion of silicone rubber, can be applied as the component of the adhesive layers of the invention, in addition to the aminosilane coupling agent, and a chlorosilane coupling agent, chloromethyl silane coupling agent, cyanosilane coupling agent, titanic acid ester coupling agent, and the like, for example, can be exemplified. The aminosilane coupling agent and the titanic acid ester coupling agent are preferably used as the component of the adhesive layers of the invention. Further, a primer designed for fluorocarbon siloxane rubber is also preferably used.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A belt member with a surface of which a toner image is contacted comprising a surface layer in which a plurality of kinds of rubbers having a different hardness mixedly exist, wherein the surface layer includes a first rubber and particles of a second rubber having a higher hardness than that of the first rubber and mixedly existing in the first rubber, the hardness of the particle of the second rubber is A10/S or more and A42/S or less over the hardness of the first rubber in terms of JIS-A hardness based on JIS K6253, and the first rubber and the second rubber are cured materials of a precursor composition that has fluorocarbon polymers composed of fluorocarbon siloxane, having a repeating unit shown by the following general structural formula (1), and an aliphatic unsaturated group, (1)

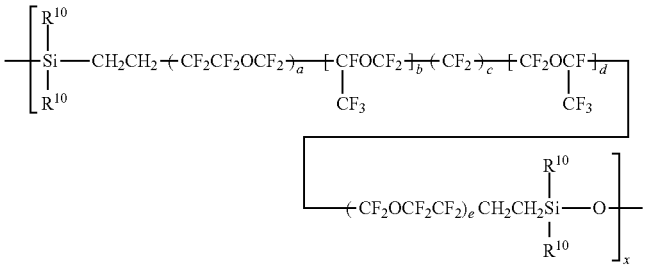

wherein $R^{10}$ represents an unsubstituted or substituted monovalent hydrocarbon group, x is an integer of 1 or more, a and e are 0 or 1, b and d are integers of 1 to 4, and c is an integer of 0 to 8.

2. The belt member according to claim 1, further comprising a belt-like base member, wherein the surface layer is a layer overlapping on the base member.

3. The belt member according to claim 1, further comprising a belt-like base member and an elastic layer overlapping on the base member and having a thickness larger than that of the surface layer, wherein the surface layer is a layer overlapping on the elastic layer.

4. The belt member according to claim 1, further comprising a belt-like base member and an adhesive layer overlapping on the base member, wherein the surface layer is a layer adhered to the base member by the adhesive layer.

5. The belt member according to claim 1, further comprising a belt-like base member, an adhesive layer that overlaps on the base member and is composed of an adhesive, and an elastic layer that is adhered to the base member by the adhesive layer and having a thickness larger than that of the surface layer, wherein the surface layer is a layer overlapping on the elastic layer.

6. The belt member according to claim 1, further comprising a belt-like base member and a rubber layer that overlaps on the base member and has a thickness of about 300 μm or less including the thickness of the surface layer.

7. The belt member according to claim 1, wherein the volume average particle diameter of the particles of the second rubber is about 1 μm or more to about 450 μm or less.

8. The belt member according to claim 1, wherein 100 parts by weight of the first rubber contain about 50 parts by weight or less to about 1 part by weight or more of the particles of the second rubber.

9. The surface treatment device according to claim 1, wherein an average hardness of the surface layer is A10/S or more and A70/S or less in terms of JIS-A hardness based on JIS K6253.

10. The surface treatment device according to claim 1, wherein an average hardness of the surface layer is A20/S or more and A60/S or less in terms of JIS-A hardness based on JIS K6253.

11. A surface treatment device comprising:

a belt member having a surface layer in which a plurality of kinds of rubbers having a different hardness mixedly exist; and a press/heat unit that presses a recording medium, on which a toner image is formed, against the belt member such that the toner image contacts the surface layer and heats the recording medium to melt at least a surface of the toner image, wherein the surface layer includes a first rubber and particles of a second rubber having a higher hardness than that of the first rubber and mixedly existing in the first rubber, the hardness of the particle of the second rubber is A10/S or more and A42/S or less over the hardness of the first rubber in terms of JIS-A (Japanese Industrial Standards) hardness based on JIS K6253, and the first rubber and the second rubber are cured materials of a precursor composition that has fluorocarbon polymers composed of fluorocarbon siloxane, having a repeating unit shown by the following general structural formula (1), and an aliphatic unsaturated group, (1)

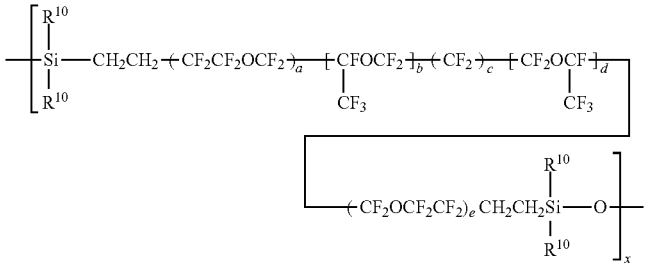

wherein $R^{10}$ represents an unsubstituted or substituted monovalent hydrocarbon group, x is an integer of 1 or more, a and e are 0 or 1, b and d are integers of 1 to 4, and c is an integer of 0 to 8.

12. The surface treatment device according to claim 11, wherein the volume average particle diameter of the particles of the second rubber is about 1 μm or more to about 450 μm or less.

13. The surface treatment device according to claim 11, wherein 100 parts by weight of the first rubber contain 50 parts by weight or less to 1 part by weight or more of the particles of the second rubber.

14. The surface treatment device according to claim 11 further comprising:

a cooling unit that cools the toner image melted through heating by the heat/press unit; and an exfoliation unit that exfoliates the recording medium with the toner image cooled by the cooling unit from the belt member.

15. The surface treatment device according to claim 1, wherein an average hardness of the surface layer is A10/S or more and A70/S or less in terms of JIS-A hardness based on JIS K6253.

16. The surface treatment device according to claim 1, wherein an average hardness of the surface layer is A20/S or more and A60/S or less in terms of JIS-A hardness based on JIS K6253.

17. An image forming apparatus comprising:

a toner image forming unit that forms a toner image on a recording medium;

a belt member having a surface layer in which a plurality of kinds of rubbers having a different hardness mixedly exist; and a surface treatment device comprising a press/heat unit that presses the recording medium against the belt member such that the toner image on the recording medium contacts the surface layer and heats the recording medium to melt at least the surface of the toner image, wherein the surface layer includes a first rubber and particles of a second rubber having a higher hardness than that of the first rubber and mixedly existing in the first rubber, the hardness of the particle of the second rubber is A10/S or more and A42/S or less over the hardness of the first rubber in terms of JIS-A hardness based on JIS K6253, and the first rubber and the second rubber are cured materials of a precursor composition that has fluorocarbon polymers composed of fluorocarbon siloxane, having a repeating unit shown by the following general structural formula (1), and an aliphatic unsaturated group, (1)

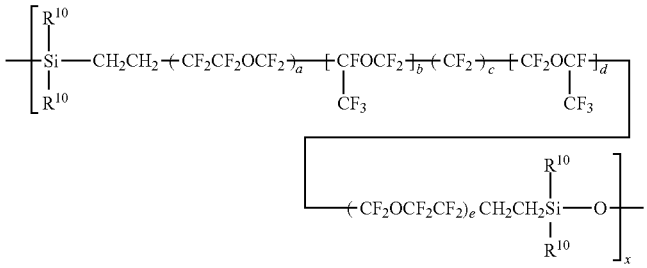

wherein $R^{10}$ represents an unsubstituted or substituted monovalent hydrocarbon group, x is an integer of 1 or more, a and e are 0 or 1, b and d are integers of 1 to 4, and c is an integer of 0 to 8.

18. The image forming apparatus according to claim 17, wherein the volume average particle diameter of the particles of the second rubber is about 1 μm or more to about 450 μm or less.

19. The image forming apparatus according to claim 17, wherein 100 parts by weight of the first rubber contain about 50 parts by weight or less to about 1 part by weight or more of the particles of the second rubber.

20. The image forming apparatus according to claim 17, comprising a cooling unit that cools the toner image melted through heating by the heat/press unit and an exfoliation unit that exfoliates the recording medium with the toner image cooled by the cooling unit from the belt member.

21. The surface treatment device according to claim 17, wherein an average hardness of the surface layer is A10/S or more and A70/S or less in terms of JIS-A hardness based on JIS K6253.

22. The surface treatment device according to claim 17, wherein an average hardness of the surface layer is A20/S or more and A60/S or less in terms of JIS-A hardness based on JIS K6253.

23. An image forming method comprising:

forming a toner image on a recording medium;

pressing the recording medium against a belt member, which has a belt-like base member and a surface layer overlapping on the base member, such that the toner image on the recording medium contacts the surface layer and heating the recording medium to melt at least the surface of the toner image; and exfoliating the recording medium from the belt member after the surface of the toner images is solidified, and the surface is melted in the pressing and the heating, wherein the surface layer includes a first rubber and particles of a second rubber having a higher hardness than that of the first rubber and mixedly existing in the first rubber, the hardness of the particle of the second rubber is A10/S or more and A42/S or less over the hardness of the first rubber in terms of JIS-A hardness based on JIS K6253, and the first rubber and the second rubber are cured materials of a precursor composition that has fluorocarbon polymers composed of fluorocarbon siloxane, having a repeating unit shown by the following general structural formula (1), and an aliphatic unsaturated group, (1)

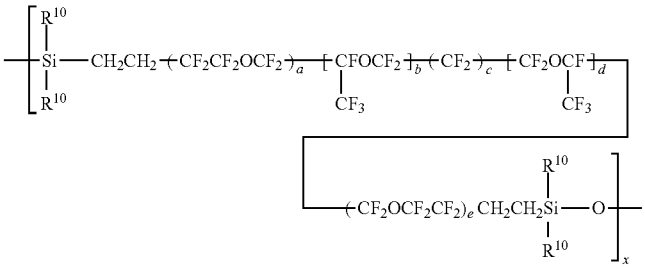

wherein $R^{10}$ represents an unsubstituted or substituted monovalent hydrocarbon group, x is an integer of 1 or more, a and e are 0 or 1, b and d are integers of 1 to 4, and c is an integer of 0 to 8.

* * * * *